United States Patent [19]

Janssen

[11] Patent Number: 4,759,968

[45] Date of Patent: Jul. 26, 1988

[54] TRANSFER GRAPHIC ARTICLE

[75] Inventor: Jeffrey R. Janssen, Woodbury, Minn.

[73] Assignee: Minnesota Mining and Manufacturing Company, St. Paul, Minn.

[21] Appl. No.: 846,752

[22] Filed: Apr. 1, 1986

[51] Int. Cl.[4] ..... B41M 5/02

[52] U.S. Cl. ..... 428/202; 428/203; 428/204; 428/211; 428/212; 428/353; 428/354; 428/423.3; 428/424.2; 428/424.4; 428/511; 428/515; 428/516; 428/914

[58] Field of Search ..... 428/201, 202, 203, 204, 428/207, 211, 914, 195, 212, 343, 353, 354, 423.3, 424.2, 424.4, 511, 515, 516, 520

[56] References Cited

U.S. PATENT DOCUMENTS

| | | | |
|---|---|---|---|
| 3,013,917 | 12/1961 | Karlan et al. | 428/914 |
| 3,065,120 | 11/1962 | Avelar | 428/914 |
| 3,298,850 | 1/1967 | Reed et al. | 428/914 |
| 3,987,225 | 10/1976 | Reed et al. | 428/914 |
| 4,114,734 | 9/1978 | Rosenfeld | 428/204 |
| 4,228,211 | 10/1980 | Haazebrook | 428/914 |
| 4,286,008 | 8/1981 | Reed et al. | 428/914 |
| 4,374,691 | 2/1983 | Vanden Bergh | 156/234 |
| 4,454,179 | 6/1984 | Bennett et al. | 428/914 |

FOREIGN PATENT DOCUMENTS

| | | | |
|---|---|---|---|
| 094182 | 11/1983 | European Pat. Off. | 428/914 |
| 04303 | 7/1986 | PCT Int'l Appl. | 428/913 |

*Primary Examiner*—Bruce H. Hess

*Attorney, Agent, or Firm*—Donald M. Sell; Gerald F. Chernivec; Robert H. Jordan

[57] ABSTRACT

A graphic design article comprising a carrier, a first adhesive layer on the carrier, a graphic design on portions of the first adhesive layer, and a second adhesive layer on the graphic design and first adhesive layer.

22 Claims, 2 Drawing Sheets

TRANSFER GRAPHIC ARTICLE

TECHNICAL FIELD

This invention relates to a thin film transfer graphic article and to methods for making and using same. More particularly it relates to an article and method for applying a thin film graphic design to substrates to provide a design thereon.

BACKGROUND ART

On site application of paint directly to a surface to be decorated is the time-honored method for providing a graphic design such as a decorative design. While this provides many aesthetic and physical features including realistic appearance, color flexibility, and durability to abrasion, weathering, and chemical attack, it also suffers from many disadvantages. Such disadvantages include the need for relatively skilled labor, long application times, and potential contamination to adjacent areas (particularly mechanical equipment). Accordingly, prefabricated film graphics have been utilized to avoid many of these disadvantages. Such graphics can be manufactured at a convenient location and subsequently applied on site by relatively unskilled labor efficiently with virtually no threat of contamination or health hazard.

One type of prefabricated graphic comprises sheets of polymeric film bearing a graphic design and a non-registered layer of adhesive under the graphic design which is protected by a liner. The sheets are die and/or "kiss cut" to provide the desired design. The design is bonded to the desired substrate by means of the adhesive layer after removal of the liner. Such graphics are generally limited to relatively simple configurations. Furthermore, accurate die and/or kiss cutting is difficult to achieve. Moreover, there is a substantial amount of material waste inherent with this method.

While die and/or kiss cutting does serve to provide a dry transfer article in which the adhesive is in registry with the graphic design, registry may also be accomplished by exact registration of the adhesive applied to the graphic design. U.S. Pat. Nos. 4,028,474 and 4,028,165 exemplify this approach. There is general recognition, however, that it is difficult and sometimes costly to achieve satisfactory alignment of adhesive and graphic, especially for intricate patterns.

Other approaches are known for aligning adhesive with the graphic design. For example, in U.S. Pat. No. 3,684,544, the adhesive is initially covered with a continuous silica coating which interferes with bonding the article to a substrate. Silica is displaced by adhesive in the regions underlying the ink design as a result of altering the adhesive rheology by applying pressure to the article causing release of a fluidity agent from the ink.

U.S. Pat. No. 4,286,008 discloses an article in which a photopolymerizable ink is screen printed onto a carrier film. In one embodiment, an article is provided with an adhesive layer overlapping the ink layer. Cleavage of the adhesive layer along the edge of the ink is taught to occur.

U.S. Pat. No. 3,987,225 discloses an article of the type having a continuous adhesive layer. The adhesive is edge stressed by incorporating a solvent or dispersing powder in the adhesive. This is asserted to permit the adhesive to shear cleanly along the edge of the design, eliminating residual particles, or strings of adhesive.

U.S. Pat. No. 4,288,525 discloses a peel-apart dry transfer material in the form of opposing support layers. A continuous photosensitive layer and a continuous image-forming layer is sandwiched between the opposing support layers. The image-forming layer may contain an adhesive component, or a separate adhesive layer may be provided between the image-forming layer and an adjacent carrier film, or the adhesive may be applied after the exposure and peel-apart development. One use of the dry transfer material is to place the developed structure on a rigid, transparent support, adhesive-side down, and irradiate through the support to provide a strong bond such that the carrier film can then be stripped away leaving the photosensitive layer, the image layer, and the adhesive bonded to the substrate.

United Kingdom Pat. No. 2,053,497 discloses a peel-apart laminate composed of opposing carrier sheets which are transparent or translucent, between which are sandwiched a continuous image-forming layer or at least one further layer which is photosensitive, and an adhesive layer. After imagewise exposure to actinic radiation through a transparency, the laminate is peeled apart providing two decals or signs, one a positive and the other a negative of the original. Either is applied adhesive-side down to a substrate with the carrier sheet providing a protective covering for the underlying image layer.

The aforementioned patents all describe approaches which rely upon mechanisms which are difficult to control or which, in some cases, dictate use of materials unable to withstand demanding environments to achieve clean separation/development of the transfer material elements. In other instances, the development mechanism dictates use of a single color graphic, a severe limitation to general use of the article. Further, in the case of prior photosensitive dry transfer articles, there is dependence upon the use of an external mask to provide the necessary exposure pattern of actinic radiation for creation of the latent image.

Yet another approach is provided in U.S. Pat. No. 4,454,179 which discloses an article having a continuous, actinic radation-transparent support, a continuous layer of an actinic radiation responsive adhesive and a graphic design interposed between the adhesive and the support. The graphic design is applied in a predetermined manner and is opaque to actinic radiation so that after the article has been exposed to such radiation through the support and applied to a substrate, removal of the support allows selective separation of the support and the radiation exposed portions of the adhesive from the substrate along the edges of the graphic design. The design and the underlying unexposed portions of the adhesive remain on the substrate. This patent describes only articles made in reverse order, that is the final color is the first applied to the support, after which the adhesive layer is applied. The use of reverse order manufacture can make color matching difficult when more than one color is to be employed in the graphic design. Additionally, this patent describes the direct application of the graphic to the support. Generally, only low adhesive forces hold the graphic to the support. This can lead to difficulty in positioning, or repositioning, the graphic on the substrate, as the graphic may release prematurely from the support.

In addition to the foregoing, carriers which are not transmissive to actinic radiation, such as paper, cannot be used with the construction immediately discussed above.

Furthermore, inks, which are conventionally used as imaging materials to prepare the graphic design, which are translucent or transparent to actinic radiation cannot be utilized therewith. In this instance, the adhesive characteristics beneath the graphic design are obviously very dependent on the effectiveness of the graphic to mask the actinic radiation. However, many colors, such as tints, translucent metallics and pearlescents are transmissive to actinic radiation, thus resulting in high adhesion loss of the graphic to the adhesive. Such a result hampers the application of the graphic because the adhesion of the second adhesive layer to the substrate is greatly reduced.

In addition, a system based on crosslinking the adhesive with actinic radiation in actually creates an adhesive with increased film properties. As a result, the force necessary to fracture the adhesive at the edge portion of the graphics is increased and results in a converse decrease in ease of application.

Further, actinic radiation-responsive adhesives are not stable to storage at elevated temperatures (i.e., 125° F.) for periods greater than about two weeks. If this occurs, loss of adhesion of the adhesive to the substrate occurs, resulting in poor application characteristics.

DISCLOSURE OF THE INVENTION

In contrast with the foregoing, the present invention provides a dry transfer article for application to a substrate to provide a design thereon, comprising a continuous support film or carrier; a continuous first adhesive coating or layer on the carrier, the first adhesive having a major surface comprising first and second surface portions; a graphic pattern or design on first surface portions of the first adhesive layer; and a continuous non-actinic radiation responsive second adhesive coating or layer having first and second segments, the first segments covering the graphic pattern over the first surface portions of the first adhesive, and second segments directly bonded to the second surface portions of the first adhesive, i.e., the exposed or uncovered areas of the first adhesive layer. The second adhesive has a fracture force less than the adhesive bond of the second adhesive segments to the second surface portions of the first adhesive, less than the adhesive bond of the second adhesive to the substrate, and less than the adhesive bond of the first adhesive segments to the graphic pattern. Furthermore, the second segments of the second adhesive have a bond force to the second surface portions of the first adhesives greater than the adhesive force of the second adhesive to the substrate.

The article can be positioned or located on the substrate such that the second adhesive layer contacts same, and after such contact, the carrier, the entire first adhesive layer, and the second adhesive segments of the second adhesive layer, i.e., those contacting the exposed portions of the first adhesive layer, are selectively removed, leaving only the graphic design and the underlying second adhesive layer on the substrate. This selective removal occurs by cleavage or separation of the graphic design from the first adhesive layer and fracture of the second adhesive layer at the edges of the graphic pattern. Thus, the second adhesive is in complete registration with the graphic pattern.

The cleavage and separation step, also referred to as development herein, results in only the graphic design and the underlying second adhesive layer, in registration, being retained on the substrate. Development does not rely upon release of agents to disrupt bonds, selective application of pressure by burnishing, nor exposure to actinic radiation. Moreover, graphic designs and adhesives employed are capable of withstanding chemically and physically disruptive forces that have served to limit use of the transfer articles as direct paint substitutes for many purposes, especially exterior usage where abrasive or environmental conditions are severe.

Upon application of the article to the substrate and removal of the carrier, the first adhesive layer and second adhesive layer contacting the exposed portions of the first adhesive layer selectively separate from the graphic design and leave only the graphic design and the second adhesive layer in registry therewith on the substrate.

Also provided is a process of making a dry transfer graphic design article comprising the steps of (a) providing a continuous carrier which preferably is capable of intimately conforming to compound surfaces, (b) applying a layer of first adhesive composition to said carrier; (c) applying a graphic design to portions of the first adhesive layer, and (d) applying a continuous layer of a second adhesive composition over the graphic design and the exposed portions of the first adhesive layer.

Still further, there is provided a method for the on-site application of a graphic design article to a substrate comprising providing the graphic design article, applying the article to a substrate so that the second adhesive layer intimately contacts the substrate, and removing the carrier from the article, thereby selectively separating the carrier, the first adhesive layer and the second adhesive layer overlying the exposed portions of the first adhesive layer from the article along the surface and edges of the graphic design, leaving the graphic design and the second layer of adhesive in registry therewith bonded to the substrate.

In the present invention the ability to develop the transfer graphic article depends upon the proper balance of the adhesive and cohesive forces between the various layers during development. While there are many force relationships involved, the principal ones to consider are the forces of adhesion between the carrier film and the first adhesive layer; between the first adhesive layer and the second adhesive layer; between the first adhesive layer and the graphic design; between the second adhesive layer and the substrate; between the graphic design and the second adhesive layer; and between the second adhesive layer in registry with the graphic design and the substrate. Each of these forces must be within proper numerical balance for the desired transfer to occur.

The article of this invention achieves the proper balance among the various relevant forces by the appropriate selection of materials useful therein.

BRIEF DESCRIPTION OF THE DRAWINGS

The invention is further explained with reference to the following drawings wherein.

DETAILED DESCRIPTION

Figure 1:
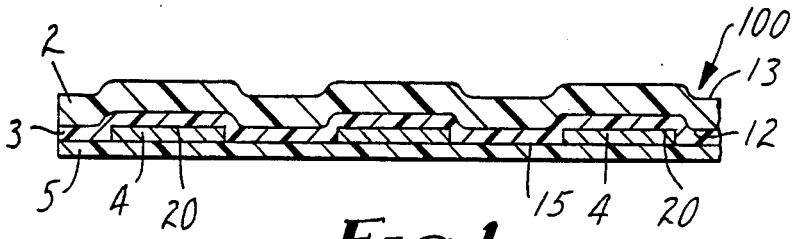
FIG. 1 is a cross-section view of the article of the invention prior to application to a substrate.

Referring to FIG. 1, article 100 comprises a continuous carrier film 2, such as paper with first adhesive layer 3 adhered to carrier surface 12. Graphic design 4 is adhered to first adhesive layer 3 at first surface portions 20. A continuous second adhesive layer 5 is adhered to graphic design 4 and exposed surface portions 15 of first adhesive layer 3, i.e., those portions not covered by graphic design 4.

Figure 2:
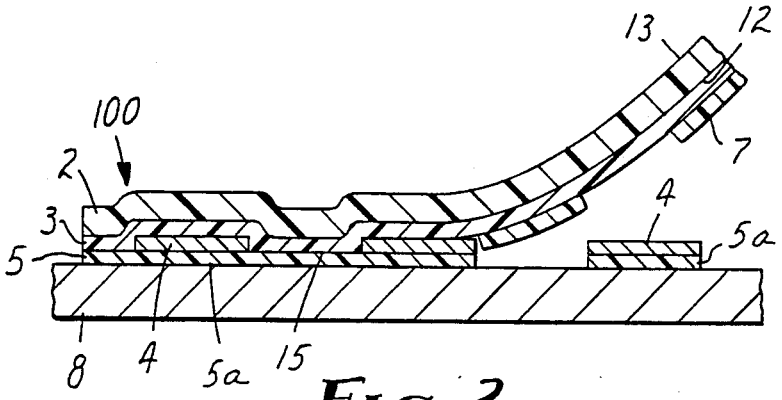
FIG. 2 is a cross-section view of the article of FIG. 1 applied to a substrate during the process of development wherein the carrier film, the associated first adhesive, and the second adhesive in direct contact with the first adhesive are partially removed.

In FIG. 2, article 100 has been applied to the surface of a substrate 8 with pressure such as may be exerted by a hand drawn squeegee or roller. Development is accomplished by, for example, applying a peeling force, here shown as being from right to left, to carrier film 2. The adhesion between surface 12 of carrier film 2 and first adhesive layer 3 exceeds the adhesion between the graphic design 4 and first surface portions of first adhesive layer 3 as at 20. Furthermore, the adhesion between exposed sections of first adhesive layer 3 and second segments 7 of the second adhesive layer exceeds the adhesion between segments 7 and substrate 8. These adhesion differentials, together with the fracture force of second adhesive 5 permit article 100 to cleave along the edges of graphic design 4 and adhesive sections **5*a* of the second adhesive layer and at the interface between graphic design 4 and first adhesive layer 3**.

The adhesion between first adhesive layer 3 and graphic design 4 is less than the adhesion between graphic design 4 and underlying adhesive sections **5*a* of the second adhesive layer, and also is less than the adhesion between those same adhesive sections 5*a* and substrate 8. As a consequence, article 100 splits as shown in FIG. 2 leaving only graphic design 4 and adhesive sections 5*a* of the second adhesive layer on the surface of substrate 8. That portion of article 100** remaining after such separation may then be discarded.

The carrier may be transparent to visible light to aid in accurately positioning the article of the invention on a substrate, and should be mutually compatible with first adhesive layer 3 so that there is no degradation of the bond between the two. The carrier is also preferably conformable to compound surfaces so that it intimately follows the contour of such surfaces without forming air bubbles or wrinkles which would either detract from the aesthetic appearance of the graphic design or adversely affect the adhesion of the graphic design to the substrate after development.

The carrier may be selected from a variety of materials. For example, polymeric materials such as polyethylene, polypropylene, and flexible poly(vinyl chloride) films and copolymers of ethylene, propylene and vinyl chloride may be used. Paper may also be used, a representative example being Type S-3178, a supercalendered flat stock saturated with latex rubber, available from the Kimberly Clark Corp. Preferably the carrier, if polymeric, is from 0.05 to 0.2 mm thick. Paper thickness is preferably 0.1 mm.

Polymeric carriers should also be free, or contain no more than limited quantities of additives which might bloom or migrate to the interface between the carrier surface and the first adhesive layer and thereby interfere with the development of the appropriate bond between the two.

Representative examples of commercially available polymeric films useful as the carrier include Crown 136 (an unoriented polypropylene film manufactured by the Crown Zellerbach Corporation), Crown 190 (an unoriented high density polyethylene film manufactured by Crown Zellerbach Corporation), and flexible poly(vinyl chloride) films.

Preferably, first adhesive layer 3 demonstrates a 180° peel strength to carrier 2 of at least about 360 grams per cm width, and to the graphic design on first surface portions 20 of about 10 to 60 grams per cm width. The peel strength may be measured by priming a 2.54 cm wide sample of unoriented polypropylene film as described in Example 1 and coating the primed surface to a wet thickness of 0.1 mm with the first adhesive composition. After drying, the construction is laminated to a film which has the same composition as the ink of Example 1. A 2.2 kg roller is passed once over the construction to laminate the film to the adhesive. The film is separated from the adhesive using a Keil Tester, manufactured by Dow Corning Corporation, and the force necessary to bring about separation is reported as the 180° peel strength. Additionally, the first adhesive layer preferably demonstrates no adhesion build-up to the graphic design after exposure to 25° C. for seven days or upon exposure to ultraviolet light.

First adhesive layer 3 can serve two functions. First, it may be used during the manufacture of the transfer graphic article. In this function it must have sufficient adhesive strength to lift the graphic design off an intermediate substrate. Second, it is used during application of the graphic design to the final substrate. In this function it holds the graphic design in place on the article of the invention and prevents its premature adhesion to the final substrate during positioning of the design. The first adhesive layer also bonds to the second adhesive layer in such a way that after removal of the carrier, those portions of the two adhesive layers in contact with each other are removed by the carrier. It is this mechanism which renders the article of the present invention self-splitting thereby making it unnecessary to employ kiss-cutting techniques to provide separation of the graphic design from the carrier.

A variety of first adhesive compositions may be used as the first adhesive layer. Examples of such compositions include rubber-based and vinyl-based compositions.

Rubber-based first adhesive compositions generally comprise either synthetic or natural rubber resins. Synthetic rubber resins, such as block copolymers composed of terminal glassy resinous polymer blocks and central elastomeric blocks, are preferred.

Typically the terminal blocks of these copolymers have a glass transition temperature above room temperature (i.e., above 20° C.). The terminal blocks usually comprise up to 15 weight percent of the copolymer and have a weight average molecular weight of between 2,000 and 100,000. Styrene is one example of a group useful as the terminal block.

The elastomeric blocks of these copolymers typically have a glass transition temperature below that of the terminal blocks and comprise recurring units of a conjugated diene such as isoprene or butylene, although polyolefin units, such as ethylene, may be included in the elastomeric blocks.

Examples of commercially available synthetic rubber resins of this type are the "Kraton" series of polymers available from the Shell Chemical Company.

Natural rubber resins (i.e., cis-1-4-poly-isoprene) useful in the invention are well known and can be obtained from a variety of sources.

The natural or synthetic rubber portion of the first adhesive composition preferably comprises from 10 to 30 weight percent of the composition and more preferably from 15 to 20 weight percent of the composition.

Vinyl-based adhesives, preferably cross-linked acrylic-based compositions, typically comprise a blend of one or more acrylic resins together with one or more other reactive ingredients. However, other vinyl-type resins may be employed in addition to, or in place of, the acrylic resins. These other vinyl-type resins include, for example, polyvinyl-n-butyl acrylate, polyvinyl-n-butyl ether and polymers of acrylic acid esters and alkyl alcohols. Yet other types of useful vinyl-based adhesives are disclosed in U.S. Pat. No. Re. 24,906. Preferably these are crosslinked by the use of a multifunctional acrylate and appropriate processing during preparation of the article of the invention.

Other useful vinyl-based adhesives comprise copolymers of alkyl acrylates, vinyl acetate and acrylic acid. For example, a composition comprising 74 parts by weight isooctylacrylate, 22 parts by weight vinyl acetate and 4 parts by weight of acrylic acid may be polymerized by conventional techniques to provide a polymer having an inherent viscosity of from 1.3 to 1.6 at 30° C. when measured at 20% by weight solids in ethyl acetate.

Multifunctional acrylates, such as trimethylol propane triacrylate, pentaerythritol triacrylate, hydantoin hexaacrylate, and triacrylate of tris-(2-hydroxyethyl-)isocyanurate (available as "Sartomer" SR-368 from Sartomer Resins, Inc.) may be added if desired. Such multifunctional acrylates are typically employed at levels of from 3 to 15% by weight of the adhesive composition.

If necessary, free radial initiators such as benzophenone, Michler's ketone, benzoin alkyl ethers, acetophenones may then be added at concentrations of from 0.5 to 5% by weight.

A test has been developed to assist in identifying suitable first adhesive compositions. In this test the adhesive is coated onto a sheet of 0.1 mm thick poly(vinyl chloride) film at a thickness of from 0.10 to 0.50 mm. The adhesive is dried at a temperature of from 30° to 55° C. until all the solvent has been removed.

A second adhesive comprising by weight
74 parts: isooctyl acrylate
22 parts: vinyl acetate
4 parts: acrylic acid
is prepared by mixing the ingredients together to provide a mixture having an inherent viscosity of from 1.3 to 1.6 at 30° C. and 20% solids by weight in ethyl acetate. This adhesive composition is coated onto a silicone coated release liner (e.g., 75-W-89-SPT6A/PS from Schoeller Release Products, Inc.) at a coating weight of 12.9 g/m$^2$ to 21.5 g/m$^2$ and dried. The carrier and first adhesive and the silicone and second adhesive are laminated together such that the two adhesives contact each other.

The silicone release liner is then removed and the second adhesive is applied to a painted steel panel and heated for one hour at 150° C. After cooling to room temperature (i.e., 18° C.) the carrier is removed. If the first adhesive being tested is suitable for use, both it and the second adhesive separate from the substrate with no ply failure (i.e., the first adhesive does not separate from the second adhesive) when the carrier is removed.

A variety of other ingredients may be added to the first adhesive layer. They include, for example, tackifiers, plasticizers, antioxidants and the like.

Tackifiers useful in the first adhesive composition are known and include, for example, rosin and rosin derivatives, polyterpene resins, coumarone-indene resins, and thermoplastic phenolic resins. Hydrogenated styrene-based resins (e.g., "Regalrez" 1194 from Hercules, Inc.) and siloxane gums are also useful in tackifying the adhesive composition. An example of a useful commercially available siloxane gum is "PSA" 590 from the General Electric Company. This siloxane gum comprises 60% by weight polydimethyl siloxane gum and polysiloxane resin in toluene.

Tackifiers useful in the first adhesive composition may comprise up to 20 weight percent thereof, and preferably they comprise from 3 to 15 weight percent.

Plasticizers useful in the first adhesive composition improve the processability and flexibility of the adhesive composition. They may comprise up to 20 weight percent and preferably from 5 to 10 weight percent of the composition. Suitable plasticizers are known to those in the art and include parafinic naphthenic oils (e.g., "Tufflo", specific gravity at 25° C. of 0.86, from Atlantic Richfield Corp.), dioctylphthalate, and the like.

Antioxidants useful in the first adhesive composition prevent degradation due to oxidation and typically comprise up to 2 weight percent of the first adhesive. Examples of useful antioxidants include "Irganox" 1010 (a hindered phenol available from Ciba-Geigy Corp.), "Tinuvin" 770 (a hindered amine available from Ciba-Geigy Corp.), and quinones.

Still other ingredients useful in the first adhesive composition include adhesion promoters, flow aids, and the like. Such other ingredients may each comprise up to 15 weight percent of the first adhesive composition.

Priming agents and techniques may be employed to improve the adhesion of the first adhesive layer to the carrier. Priming agents and techniques are particularly useful when the carrier comprises polyethylene or polypropylene. Priming agents typically comprise a layer of a priming composition, while priming techniques typically comprise a surface treatment such as corona treatment.

The first adhesive layer may be coated onto the carrier from a solution and the solvent then removed, preferably by heating at a temperature lower than a softening point of the carrier. Further processing of the adhesive layer is not necessary if a rubber-based adhesive has been used. If an acrylic-based adhesive has been used, crosslinking with either heat or ultraviolet light can be used to generate appropriate adhesion characteristics. In either event, it is preferred that the first adhesive layer have a thickness in the range of from 0.02 to 0.3 mm and preferably a thickness in the range of from 0.03 to 0.15 mm.

The material which comprises the graphic design in the invention may be comprised of colored or non-colored (i.e., visibly transparent) ink compositions. Non-colored (i.e., clear) inks will typically be used as protective top coats or layers over the colored inks.

Ink formulations useful herein preferably contain a polymeric component, preferably a high tensile strength polymer or resin such as polyvinyl butyral, cellulose nitrate, cellulose acetate, alkyds and alkyds modified or copolymerized with drying oil, styrene, urethane, vinyl, acrylic resin, polyvinylhalides, polyurethanes, urethane-acrylates, epoxy polymers, epoxy-phenolic, epoxy-polyamide and catalyzed epoxy resins and copolymers, chlorinated and isomerized rubber, polystyrene and polyvinyl toluene, polyacrylates, polymethacrylates, and thermosetting acrylic resins. The ink may be applied as a solution, dispersion or emulsion in organic solvent medium or water, the solvent or water being removed after application. Any convenient pigment well known for use in printing inks may be used in the ink formulations including pigments modified by coating the pigment particles with surface active agents to improve dispersibility and increase covering power.

The ink may be applied by a variety of conventional coating or printing techniques. Screen printing is a preferred technique. The resultant graphic can be a monolayer or multi-layers, and can be a mono-color or multicolor image. It typically ranges in overall thickness from 0.0075 mm to 0.025 mm.

The second adhesive layer employed in the invention must be capable of bonding to the graphic design with a force sufficient to retain the design thereon during development, and depends somewhat on the substrate and environment the graphic design is to be used in. For example, for transfer to automotive exterior panels, it is preferred that this force be at least about 650 grams/cm width. In other words, this bonding force is not critical to the application and transfer of the graphic design, but is extremely crucial to the end performance of the graphic system once applied to a substrate. In addition, the bond to the substrate that the graphic is to be applied to must be sufficient to allow transfer and subsequent adhesion, preferably at least about 180 grams per cm width. Also in this regard, the fracture force of the adhesive must be low enough to allow selective fracture at areas in association with the graphic design, and preferably less than about 35 grams.

With regard to the fracture force of the second adhesive, same can be determined by the following test procedure. In essence, this test measures the force necessary for the adhesive to fracture at the edge of the graphic design, thus providing a clean break between graphic and non-graphic areas, such that the second adhesive adhered to the substrate is in complete registration with the graphic design.

First of all, the adhesive to be tested must be coated on a silicone release liner (75 W-81-SPT3A/PS, commercially available from Schoeller Release Products Inc.). Solvents are evaporated by baking the adhesive for 10 minutes at 200° F. The coating weight of the adhesive is measured by cutting a 155 $cm^2$ section of adhesive coated release liner, removing the adhesive, and weighing the adhesive. Typical coating weights for this construction are 1.0–5.0 grains per 155 $cm^2$. A 1-inch by 12-inch piece of polyvinyl chloride film (A 0.07 mm "Scotchcal" Brand Film from 3M Company, without adhesive) is laid flat on a 12-inch by 12-inch piece of the same polyvinyl chloride film. The adhesive is then laminated over the entire surface of both vinyl films, i.e., it is a continuous layer which covers both polymeric films. The lamination operation is done at room temperature between rubber rolls (70 durometer hardness) at a pressure of 67.7 newtons/$cm^2$. The 1-inch polyvinyl chloride film is then removed at a 180° angle from the second film using a conventional Keil tester from Dow Corning Corporation. The force measured is the force needed to fracture at the edge of the 1-inch strip of polyvinyl chloride film.

It should be noted that the bond strength of the second adhesive layer to the substrate and the fracture force are both critical to achieve proper application transfer. Adhesion of the second adhesive to the substrate is measured by coating the adhesive with a notch bar coater on a release liner (75 W-89-SPT3A/PS from Schoeller Release Products Inc.). Solvents are evaporated by baking the adhesive 10 minutes at 200° F. The coating weight is measured as described in the previous paragraph. The adhesive is then laminated to polyvinyl chloride film (non-adhesive coated "Scotchcal" Brand Film from 3M Company) at room temperature with a force of 67.7 newtons/$cm^2$ between two 70 durometer hardness rubber rolls. The adhesive is tested by cutting a 2.54 cm wide strip of adhesive coated film, removing the release liner and laminating the film to a substrate with the aid of a squeegee (3M Brand PA-1 plastic squeegee). Immediate adhesion is measured by peeling the adhesive-coated film at 180° from the substrate using a conventional Instron device within one minute of the application to the substrate.

Table I describes the fracture force and the immediate adhesion of several adhesives. The adhesives were tested using the technique described in the previous paragraphs. The substrate used for the evaluation was a steel panel coated with Ford Motor Company enamel No. ESB-M50J. A qualitative judgment on the application properties of the adhesives in the graphic design article is also listed in Table I when the graphic design article is assembled using the process outlined in Example I. The adhesives described in Table I were polymerized using common polymerization techniques in acetone. The polymers were diluted to 15 percent solids with toluene prior to coating.

TABLE 1

| Adhesive | Composition | Coating Weight | Fracture Force (grams) | Initial Adhesion (grams/cm) | (Immediate Application) Performance as a Graphic |
|---|---|---|---|---|---|
| methyl butyl acrylate/-acrylic acid | 90/10 | A | 18 | 90 | Poor |
| | | B | 25 | 120 | Poor |
| | | C | 33 | 240 | Fair |
| isooctyl acrylate/vinyl acetate/acrylic acid | 56/40/4 | A | 23 | 90 | Poor |
| | | B | 35 | 180 | Fair |
| | | C | 41 | 270 | Poor |
| isooctyl acrylate/vinyl acetate/acrylic acid | 74/22/4 | A | 22 | 200 | Excellent |
| | | B | 28 | 280 | Good |
| | | C | 31 | 360 | Good |
| isooctyl acrylate/acrylic acid | 94.5/5.5 | A | 8 | 280 | Excellent |
| | | B | 11 | 360 | Excellent |
| | | C | 16 | 430 | Excellent |
| isooctyl acrylate/- | 60/32.5/7.5 | A | 19 | 170 | Good |

TABLE 1-continued

| Adhesive | Composition | Coating Weight | Fracture Force (grams) | Initial Adhesion (grams/cm) | (Immediate Application) Performance as a Graphic |
|---|---|---|---|---|---|
| methylacrylate acrylic acid | | B | 32 | 280 | Fair |
| | | C | 40 | 360 | Poor |
| isooctyl acrylate/- | 60/32.5/7.5 | A | 21 | 280 | Good |
| ethyl acrylate/acrylic acid | | B | 30 | 540 | Good |
| | | C | 39 | 580 | Poor |

Figure 3:
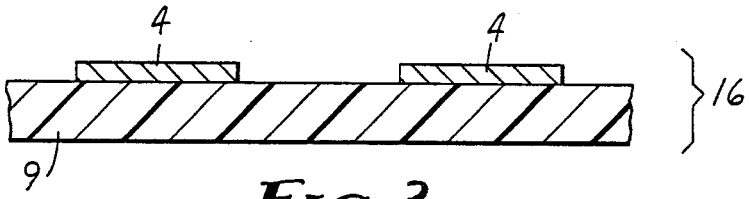
FIGS. 3–7 are cross-section views of a method of manufacturing the article of the invention.

A = 2.5 grains/4" × 6" panel
B = 4.0 grains/4" × 6" panel
C = 5.5 grains/4" × 6" panel FIGS. 3–7 demonstrate one technique for manufacturing the article of the invention. In FIG. 3 a layer of ink composition is selectively applied to a release liner 9 to provide a structure 16 bearing graphic design 4. One or more layers of ink may be applied if desired to provide a multi-color graphic, or, as previously noted, to provide a clear coating over the final graphic design. The ink is allowed to dry or cure depending on the type of ink employed. Screen printing is the preferred ink application method although many conventional coating and printing techniques may be employed.

A variety of techniques may be utilized to apply a non-colored or clear layer over the graphic 4. For example, the clear coating may be applied in exact registry over the graphic. When this application technique is utilized, the final article retains the ability to be self-splitting.

Structure 16 is then applied to a premask tape 10 as shown in FIG. 3. Premask tape 10 comprises carrier 2 and first adhesive layer 3 and is prepared as described above. Premask tape 10 and structure 16 are placed in face-to-face contact with graphic design 4 contacting first surface portions of first adhesive layer 3. The resulting construction 17 may then be passed through rubber rolls which apply sufficient pressure to cause graphic design 4 to adhere to first adhesive layer 3 with greater force than it adheres to release liner 9. Typical forces of 10 g/cm to 60 g/cm are sufficient to accomplish this.

Figure 4:
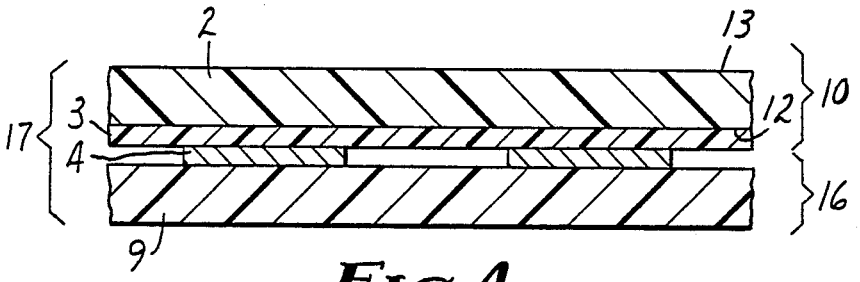
Figure 5:
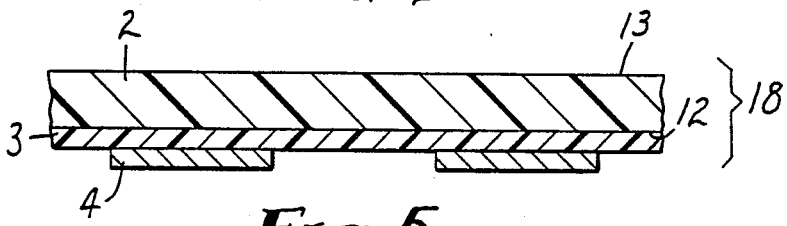
Figure 6:
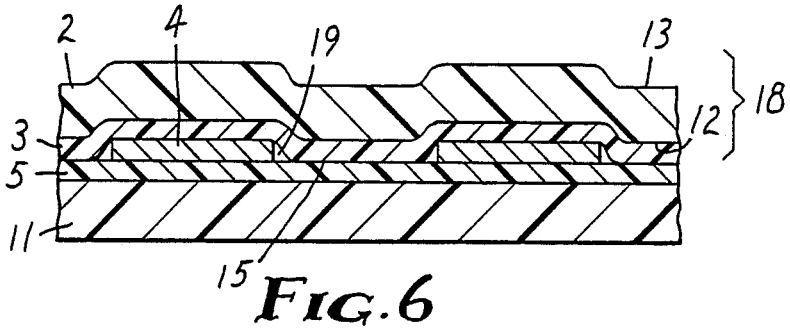

Release liner 9 is then removed from construction 17 to provide the multilayer film 18 shown in FIG. 4. Film 18 can preferably then be corona treated (not shown) to insure that the surface made up of the graphic design 4 and the first adhesive layer 3 will have the proper adhesion to the second adhesive layer. Such treatment is particularly preferred when urethane-based ink systems are used as the graphic design. Treatment may be accomplished by exposure to a corona discharge (in an ENI Power Systems Model RS-8 Corona Surface Treater, for example) to provide increased surface free energy.

Figure 7:
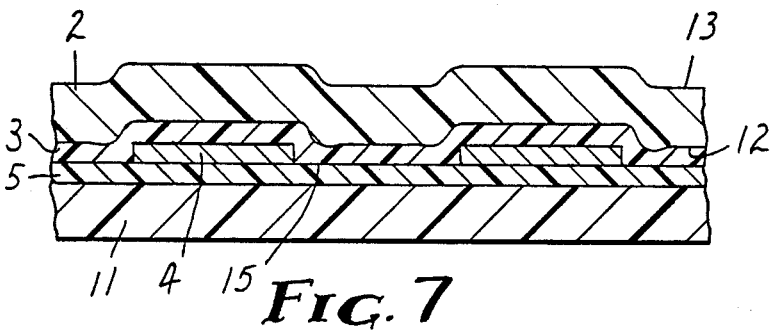

After the corona treatment (if used), second adhesive layer 5 may be applied either by coating and drying a layer of the second adhesive directly onto the graphic and first adhesive layer surface or by using a transfer technique. In the transfer technique, second adhesive composition 5 is coated onto a release liner such as silicone-coated paper 11 (see FIG. 6) using conventional coating and drying techniques. The resulting construction may then be laminated to film 18 to provide the article shown in FIG. 6. Although the lamination causes carrier 2 and first adhesive layer 3 to generally conform to and surround the graphic design 4, it typically does not eliminate all spaces 19 between first adhesive layer 3 and graphic design 4. Spaces 19 may be removed by applying a rotating brush to surface 13 of carrier 2 to force carrier 2 and first adhesive layer 3 around graphic design 4 and against second adhesive layer 5 as shown in FIG. 7. To aid in achieving this result, it is preferred that carrier 2 be a material which is slightly softenable when heated. This step insures that the article of the invention will split cleanly along the edges of the graphic design removal of the carrier.

Upon use, the release liner is removed and the article positioned on the desired substrate. Moderate pressure is applied by stroking a squeegee across the face of the carrier film. The carrier film is then grasped manually and peeled away, taking with it the appropriate first and second adhesive layers and leaving the graphic design bonded to the substrate by means of the underlying second adhesive. If necessary, further pressure can be applied to the graphic surface to assure a stronger bond to the substrate.

The invention will now be further illustrated by the following non-limiting examples, wherein all parts and percentages are by weight unless otherwise stated.

EXAMPLE 1

A self-splitting graphic design article according to the invention was prepared. Polypropylene resin (polypropylene 3300, an extrudable polypropylene sold by Norchem Corporation having a number average molecular weight of 320,000) was extruded at a die temperature of 217° C. to form an unoriented 0.075 mm thick film. One surface of the film was corona treated at 500 watts for a 0.75 meter width at a speed of 20 m/min. the corona-treated film was then primed with a layer of a composition containing:

| Component | Description | Weight |
|---|---|---|
| Neoprene W | Polychloroprene (E. I. Du Pont de Nemours and Company, Inc.) MW 180,000–200,000 | 5.0% |
| Mondur CB-75 | Trimethylol propane - Toluene diissocyanate polymer (Mobay Chemical Corp.; 75% solids in Toluene; NCO content 13–14%; Equivalent Wt. 311) | 0.3% |
| Ucar Phenolic Resin | p-tert-Butylphenol-formaldehyde polymer (Union Carbide Corp.) | 1.0% |
| Toluol | | 93.7% |

The primer was applied with a 150 knurled cylinder. After coating, the toluol was removed by air convection in an oven at 40° C.

A first adhesive layer was applied to the primed surface of the polypropylene film from the following composition.

| Component | Description | Weight % |
|---|---|---|
| "Kraton" GX 1657 | Polystyrene/poly(ethylene-butylene)/-polystyrene block copolymer (14% polystyrene); specific gravity 0.9; solution viscosity (20% by weight in toluol, 110 cps; available from Shell Chemical Co.) | 20.7 |
| "Tufflo" 6056 | Paraffinic naphthenic oil (Specific gravity at 25° C. of 0.86; available from Atlantic Richfield Corp.) | 6.0 |
| "Regelrez" 1094 | Hydrogenated styrene-type polymer (Available from Hercules, Inc. | 6.0 |
| "PSA" 590 | 60% Polydimethylsiloxane gum and polysiloxane resin in toluene (Available from General Electric Company) | 4.3 |
| "SR" 545 | 60% Silicone resin in toluene (Available from General Electric Company) | 2.1 |
| "Irganox" 1010 | Hindered phenolic antioxidant $M_w$ 1178; available from Ciba-Geigy Corp.) | 0.2 |
| Toluol | | 61.7 |

The composition was knife coated to a wet thickness of 0.13 mm. The solvents were then evaporated from the composition by a convection oven at 40° C. The resulting adhesive-coated polypropylene was then rolled up on itself and stored for subsequent use.

A graphic design was screen printed on a 118 g/m$^2$ leached low moisture base paper coated with 37.5 m (36 g/m$^2$) of high density polyethylene (HDPE). (This paper is manufactured by Schoeller Technical Papers, Inc.) The following ink formulation was used to provide the graphic design. It was printed with a 110 mesh screen onto the HDPE surface of the paper:

| Component | Description | Weight % |
|---|---|---|
| "VYHH" Resin | 87% Polyvinyl chloride/13% polyvinyl acetate copolymer (Inherent viscosity; 0.49–0.52, ASTM-D-1243 Method A, available from Union Carbide Corp.) | 22.0 |
| "Raven" | Carbon black pigment | 7.7 |

-continued

| Component | Description | Weight % |
|---|---|---|
| 1200 | (Available from City Service, Inc.) | |
| Dioctyl-phthalate | | 4.3 |
| Cyclo-hexanone | | 33.0 |
| Isophorone | | 33.0 |

The ink formulation was prepared by dissolving the polyvinyl chloride/polyvinyl acetate copolymer in the cyclohexanone, isophorone and diooctylphthalate. The carbon black was ground into this solution using a three roll paint mill to a fineness of grind of at least 8 on the P.C. scale. The resulting mixture was diluted with isophorone as needed to provide a viscosity of 1300 cps using a Brookfield viscometer No. 3, spindle. After the ink is printed, the solvents were evaporated in an air convection oven at 50° C.

A non-pigmented, non-adhesive composition was screen printed using a 110 mesh screen in registration with the graphic design. This protective clear coat had the following formulation:

| Component | Description | Weight % |
|---|---|---|
| "Desmophen" 651A-65 | Rigid polyester polyol (Viscous liquid, 65% solids in ethyl glycol acetate; equivalent Wt. of 325; % hydroxyl of 5.2; available from Mobay Chemical, Inc.) | 46.50 |
| "Desmophen" 670-90 | Flexible polyester polyol (Viscous liquid, 100% solids; equivalent wt. of 395; % hydroxyl of 4.3; available from Mobay Chemical, Inc.) | 12.50 |
| "Desmodur" N-100 | Aliphatic polyisocyanate (Viscous liquid, 100% solids; equivalent wt. of 190; % NCO of 22; available from Mobay Chemical, Inc.) | 31.00 |
| "Tinuvin" 770 | Hindered amine stabilizer (Available from Ciba Geigy, Inc.) | 0.9 |
| "Tinuvin" 328 | Benzotriazole UV absorber (Available from Ciba Geigy, Inc.) | 3.0 |
| "Multiflow" | An acrylic copolymer resin solution 50% in xylene; specific gravity 25/25° C. of 0.925–0.940; refractive index at 25° C. of 1.481–1.485; available from Monsanto Industrial Chemical Co.) | 1.8 |
| FC-430 | Fluorocarbon flow additive (Available from 3M Co.) | 1.0 |
| "Carbitol" acetate | Diethylene glycol monoethyl ether acetate (available from E. I. du Pont de Nemours, Inc.) | 5.1 |

The non-pigmented formulation was prepared by mixing the components together in a Cowles mixer. The formulation was diluted with "Carbitol" acetate to a viscosity of 500 cps (Brookfield viscometer No. 3 spindle). After the non-pigmented layer was printed, the construction was baked for two hours at 55° C.

The HDPE coated paper bearing the graphic design was laminated to the previously described adhesive coated polypropylene carrier so that the first adhesive layer and the graphic were in contact by passing the construction between soft rubber rolls each having a 70 Durometer hardness such that a pressure of 67.7 newtons/cm$^2$ was applied. The HDPE coated paper was then removed and discarded.

The resultant structure was corona treated on the surface bearing the first adhesive and graphic by exposing the structure to a 500 watt corona discharge at a speed of 20 m/min.

A continuous second adhesive layer was then applied over the graphic and the first adhesive layer from the following composition:

| Component | Description | Weight % |
|---|---|---|
| Adhesive Polymer | 74% isooctyl acrylate/22% vinyl acetate/4% acrylic acid | 19.6 |
| Ethyl acetate | | 80.4 |

This adhesive formulation was prepared by mixing the ingredients together at room temperature, coating the solution onto a silicone coated, white polyethylene sheet (05-4-HiD-ST6A/ST3A-White from Schoeller Release Products, Inc.) to a wet thickness of 0.075 mm, and evaporating the solvent by heating the film for 3 minutes at 58° C.

The corona treated, graphic design bearing, adhesive coated polyethylene carrier was laminated to the second adhesive layer such that the second layer of adhesive contacted the corona treated surface of the first adhesive layer and the graphic design. The lamination was passed between rubber rolls (70 Durometer hardness) at a pressure of 67.7 newtons/cm$^2$. This lamination was then passed over an oil-heated can at a temperature of 82° C. As the lamination passed over the hot can the unoriented polypropylene carrier side of the lamination was vigorously brushed with a coarse rotating brush to insure good lamination of the two adhesive layers and eliminate any air spaces between the first layer of adhesive at the edges of the graphic design.

EXAMPLE 2

Example 1 was repeated with the following changes. Protective clearcoat formulation comprised:

| Component | Description | Weight % |
|---|---|---|
| XP-173-09 | Aliphatic urethane acrylate oligomer diluted with 25% 2-ethylhexylacrylate (Viscosity at 20° C.; 21,000 + 2000 cps available from Cargill, Inc.) | 64.3 |
| Tetraethylene glycol diacrylate | $M_w$ of 302 (Available from Celanese Co.) | 21.7 |
| N—vinyl-2-pyrrolidone | Colorless liquid, Bp 146° C., $M_w$ of 111 (Available from GAF Corp.) | 10.0 |
| "Multiflow" | Monsanto Industrial Chemicals Company | 2.0 |
| Diethoxyacetophenone (DEAP) | Upjohn Chemical Co. | 2.0 |

The formulation was prepared by mixing the components at room temperature until a homogeneous mixture is achieved.

The formulation was printed in registration with the ink layer using approximately 110 mesh screen. The protective clearcoat was cured by actinic radiation in a Linde Photocure System with four defocussed medium pressure mercury vapor lamps. The lamps were 0.75 meters above the coating. The bulbs had an intensity of 31 watts/cm$^2$. The belt speed of the curing unit was 10 meter/minute. Nitrogen was passed through the curing chamber at a rate of 225 cubic feet of $N_2$/ft. width of curing chamber to provide a nitrogen environment therein.

A second adhesive layer was applied using the formulation and procedures described in Example 1. The self-splitting graphic design article was then processed and applied to a steel substrate described in Example 1. After the carrier film was peeled off the substrate surface, the graphic design was left on the substrate. No adhesive remained on the top or the edges of the graphic or on the surfaces of the substrate where there was no graphic design.

EXAMPLE 3

Example 1 was repeated except that the following single layer graphic design formulation was substituted for the dual layer graphic design used.

| Component | Description | Weight % |
|---|---|---|
| "Desmophen" 670-90 | Available from Mobay Chemical Inc. | 20.4 |
| "Desmophen" 651A-65 | Available from Mobay Chemical Inc. | 27.4 |
| "Tinuvin" 770 | Bis(2,2,6,6-Tetramethyl-4-piperidinyl)sebacate (Available from Ciba Geigy) | 0.7 |
| "Tinuvin" 328 | Benzatriazole (Available from Ciba Geigy) | 1.3 |
| "Raven" 1200 | Carbon black (Available from City Services, Inc.) | 4.6 |
| "Multiflow" | Available from Monsanto Industrial Chemicals Company | 1.5 |
| "Desmodur" N-100 | Available from Mobay Chemicals Inc. | 27.5 |
| Butyl Cellosolve Acetate | | 17.6 |

The silicone coated polyethylene film was removed and the article placed on a steel substrate such that the second layer of adhesive was against the surface of the steel substrate. Moderate pressure was applied to the free surface of the carrier film by stroking that surface with the edge of a polyethylene squeegee (3M Company PA-1 plastic applicator tool) over the film structure. The carrier film was then peeled off the substrate surface leaving the graphic design on the substrate. No adhesive remained on the top or the edges of the graphic or on the surfaces of the substrate where there was no graphic design.

The polyol resins, the stabilizers, the flow additives, and solvent were all mixed together. The carbon black was ground into the polyol solution using a three roll paint mill to a fineness of grind of at least 8 on the P.C. scale. Just prior to screen printing the graphic design formulation, the isocyanate was added to the solution. This composition was then diluted to 800 cps using a Brookfield viscometer, No. 3 spindle. The graphic design composition was screen printed on the HDPE coated paper from Schoeller Technical Papers, Inc. described in Example 1 with a 110 mesh screen. The carrier bearing the graphic design formulation was baked for 2 hours at 68° C. to remove solvents and speed up the reaction between the isocyanate and the polyols. When the resultant self-splitting graphic design article was processed and applied to a steel substrate as described in Example 1, it was found that the carrier film peeled off the substrate surface leaving the graphic design on the substrate. No adhesive remained on the top or the edges of the graphic design or on the surfaces of the substrate where there was no graphic design.

EXAMPLE 4

Example 1 is repeated except that the following second adhesive composition was used.
Isooctyl acrylate: 94.5
Acrylic acid: 5.5.

The adhesive was notch bar coated onto a silicone-coated white polyethylene sheet (No. 05-4-HID-ST6A/ST3A-White, commercially available from Schoeller Release Products, Inc.) to a wet thickness of 0.075 mm, and the solvent was evaporated by heating the film for 3 minutes at 58° C.

The adhesive was then laminated to the graphic design on the carrier and first adhesive of Example 1. When transfer was undertaken as per Example 1, similar results were obtained.

EXAMPLE 5

Example 1 was repeated with the exception that the following carrier and first adhesive system was used. The carrier was an 0.1 mm super calendered saturated flat stock paper, Type S-3178, commercially available from Kimberly-Clark Corp. This web was notch bar coated with the following adhesive composition to a wet thickness of 0.1 mm.

| Component | Weight % |
|---|---|
| Poly-n-butylacrylate, having an inherent viscosity of 2.0 at 20% solids in ethyl acetate | 98.0 |
| Benzophenone | 2.0 |

The solvent was evaporated by exposure to 100° C. for 30 seconds. The adhesive was then crosslinking with actinic radiation by exposure to 0.663 Joules/cm$^2$ from two focused medium pressure mercury lamps at a web speed of 100 ft/min. When the balance of Example 1 was repeated, results similar thereto were obtained.

What is claimed is:

1. A dry transfer article for application to a substrate to provide a design thereon comprising (a) a carrier;

(b) a continuous first adhesive on said carrier, said first adhesive having first and second surface portions;

(c) a graphic pattern comprising at least one layer of an imaging composition, said pattern being releasably bonded to said first surface portions of said first adhesive;

(d) a continuous non-actinic radiation responsive second adhesive having first segments covering said graphic pattern over said first surface portions of said first adhesive, and second segments directly bonded to said second surface portions of said first adhesive, said second adhesive having a fracture force less than the adhesive bond of said second segments to said second surface of said first adhesive, less than the adhesive bond of said second adhesive to said substrate, and less than the adhesive bond of said first segments to said graphic pattern; said second adhesive having a bond force to said first adhesive greater than the bond force of said second adhesive to said substrate; whereby, upon adhering of said article to said substrate, application of a peel force to said carrier film allows selective separation from said substrate of said carrier film, together with said first adhesive and said second segments of said second adhesive along the edge of said graphic pattern, leaving on said substrate said graphic pattern and first segments of said second adhesive in registry therewith.

2. The article of claim 1 wherein said carrier is a paper.

3. The article of claim 1 wherein said carrier has at least one surface comprising a material selected from the group consisting of polyethylene, polypropylene, poly(vinyl chloride) and copolymers of ethylene, propylene, and vinyl chloride.

4. The carrier of claim 3 wherein said material is polypropylene.

5. The article of claim 1 wherein said first adhesive layer is selected from a rubber-based composition and a vinyl-based composition.

6. The article of claim 5 wherein said first adhesive layer comprises a vinyl-based composition.

7. The article of claim 1 wherein said carrier is capable of forming intimately to compound surfaces.

8. The article of claim 1 further comprising a primer layer interposed between said carrier and said first adhesive layer.

9. The article of claim 1 wherein the adhesive bond between said first adhesive and said carrier is at least about 360 grams/cm.

10. The article of claim 1 wherein the adhesive bond between said graphic pattern and said first surface portions of said first adhesive is from about 10 to about 60 grams/cm.

11. The article of claim 1 wherein said imaging composition comprises an ink.

12. The article of claim 11 wherein said ink is selected from the group consisting of vinyl-based inks and polyurethane-based inks.

13. The article of claim 1 wherein a clear protective layer is interposed between said graphic pattern and said first adhesive layer in registry with said graphic pattern.

14. The article of claim 13 wherein said clear protective layer comprises a polyurethane.

15. The article of claim 1 wherein said graphic pattern comprises a multicolor design.

16. The article of claim 1 wherein said second adhesive comprises a terpolymer selected from the group consisting of isooctyl acrylate/vinyl acetate/acrylic acid terpolymers and isooctyl acrylate/ethyl acetate/acrylic acid terpolymers.

17. The article of claim 1 wherein said adhesive bond of said first segments of said second adhesive to said graphic pattern is at least about 650 grams/cm.

18. The article of claim 1 wherein said adhesive bond of said second adhesive to said substrate is at least about 180 grams/cm.

19. The article of claim 1 wherein said fracture force of said second adhesive is less than about 35 grams.

20. The article of claim 1 further comprising a protective liner over said second adhesive layer.

21. The article of claim 1 wherein said graphic design and said second surface portions of said first adhesive layer have been corona discharge treated prior to application thereto of said second adhesive layer.

22. The article of claim 1 wherein said graphic pattern comprises a screen printed ink composition.

* * * * *

UNITED STATES PATENT AND TRADEMARK OFFICE

CERTIFICATE OF CORRECTION

PATENT NO. : 4,759,968

DATED : July 26, 1988

INVENTOR(S) : Jeffrey R. Janssen

It is certified that error appears in the above-identified patent and that said Letters Patent is hereby corrected as shown below:

Col. 12, Line 56, "diissocyanate" should be --diisocyanate--.

Signed and Sealed this

Twenty-eighth Day of February, 1989

*Attest:*

DONALD J. QUIGG

*Attesting Officer*

*Commissioner of Patents and Trademarks*